United States Patent [19]

Moxness

[11] 4,218,157

[45] Aug. 19, 1980

[54] PARKING LOT MARKER APPARATUS

[76] Inventor: Kermit W. Moxness, 909 SW. Kenyon, Des Moines, Iowa 50315

[21] Appl. No.: 935,452

[22] Filed: Aug. 21, 1978

[51] Int. Cl.[2] ..... E01F 13/00

[52] U.S. Cl. ..... 404/6; 404/9

[58] Field of Search ..... 404/9, 6; 52/174; 116/28 R

[56] References Cited

U.S. PATENT DOCUMENTS

| | | | |
|---|---|---|---|
| 1,669,659 | 5/1928 | Devereux | 116/28 R |
| 2,454,896 | 11/1948 | Traub | 116/28 R |
| 3,782,322 | 1/1974 | Wilson | 116/63 P |
| 3,817,203 | 6/1974 | Brauer | 115/28 R |
| 3,844,050 | 10/1974 | Lynn | 116/28 R X |
| 3,874,322 | 4/1975 | Bramer | 116/28 R |
| 4,036,165 | 7/1977 | Wood | 116/28 R |
| 4,078,867 | 3/1978 | Ronden | 404/10 |

*Primary Examiner*—Nile C. Byers, Jr.

*Attorney, Agent, or Firm*—Henderson & Sturm

[57] ABSTRACT

This invention is directed to a visual vehicular parking aid in general, and more specifically to a plurality of vertically suspended position indicators to direct a person driving an automobile into a parking space when the normal pavement markings are not visible or present.

8 Claims, 3 Drawing Figures

PARKING LOT MARKER APPARATUS

BACKGROUND OF THE INVENTION

During the winter months, in many areas of the country, heavy snow storms cover the ground, temporarily obliterating normal visual landmarks and other signs or indicators which govern and direct a person's day to day routine. Pavement markings such as those used to indicate parking spaces and the accepted distance between cars in an unprotected parking lot are naturally covered even with a small accumulation of snow. When the pavement markings are no longer visible people have a tendency to park their vehicles randomly, haphazardly, and with little or no regard for the safety or convenience of others. Static barriers and traffic islands have been erected in an attempt to resolve this problem; however, these are costly to erect and maintain and they are an impediment to snow removal equipment. These elevated barriers also can cause damage to a vehicle which runs over them or backs into them. Another problem with painted pavement parking space markers, even in the absence of snow, is their tendency to be worn away by repeated vehicular traffic, and the necessity to constantly repaint the lines to maintain their effectiveness.

Consequently there is a need for structures to avoid these problems with the prior art.

SUMMARY OF THE INVENTION

An object of the present invention is the provision of a highly visible parking space marker, which is easy to construct and install, is durable, and requires little or no maintenance.

Another object is to provide a parking space marker which is effective when snow covers the customary pavement lines, and also does not present an impediment to snow removal equipment.

A further object of the invention is the provision of an elevated parking space marker which will allow vehicles to pass through the flexible markers without incurring body damage.

Still another object of the invention is to provide a parking space marker which will be highly visible regardless of the time of day or the prevailing weather conditions.

Other objects, advantages, and novel features of the present invention will become apparent from the following detailed description of the invention when considered in conjunction with the accompanying drawings.

DESCRIPTION OF THE INVENTION

Figure 1:
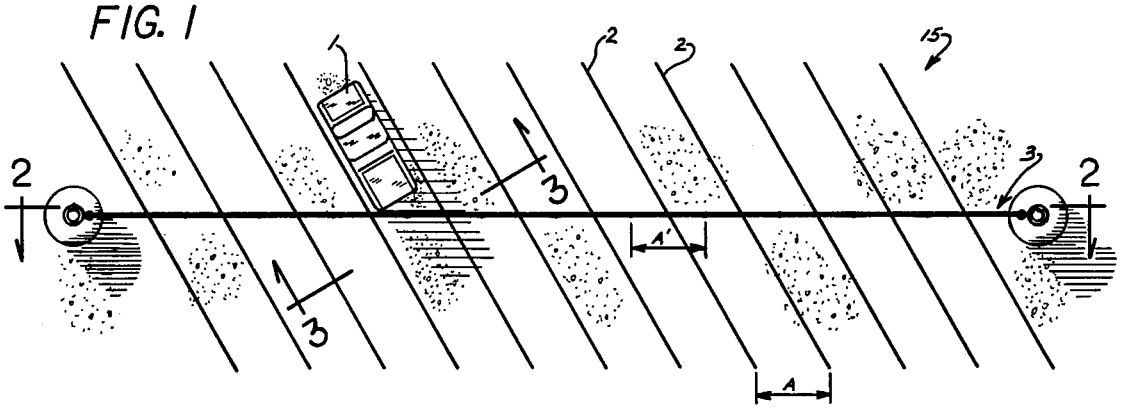
FIG. 1 is an elevational view of the parking space marker of the instant invention employed in conjunction with painted pavement lines.
Figure 2:
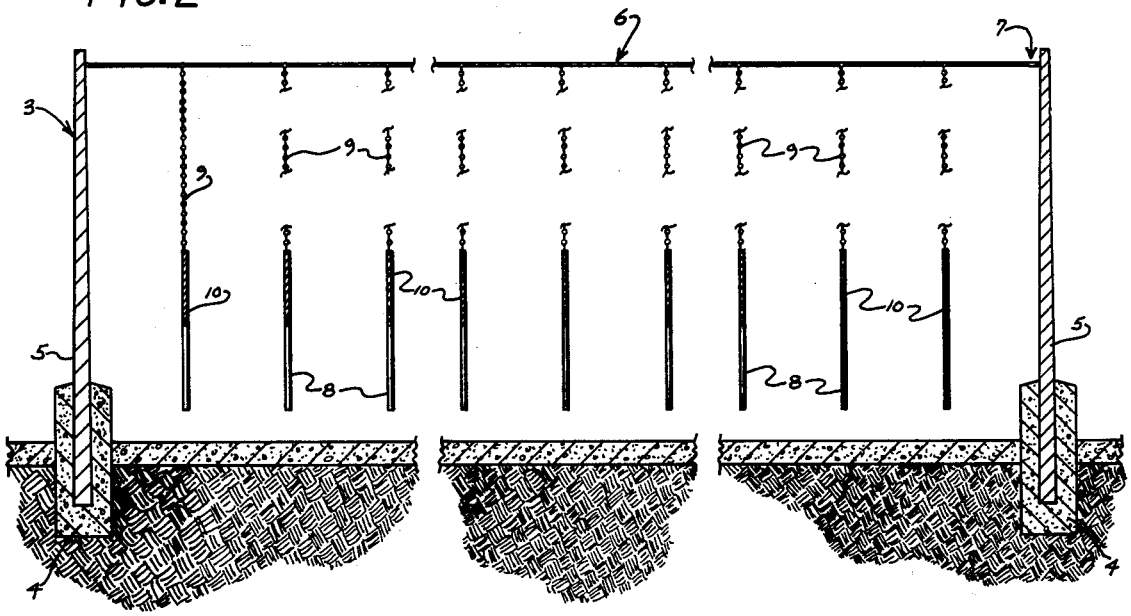
FIG. 2 is a sectional view of the parking space marker taken through line 2—2 of FIG. 1.
Figure 3:
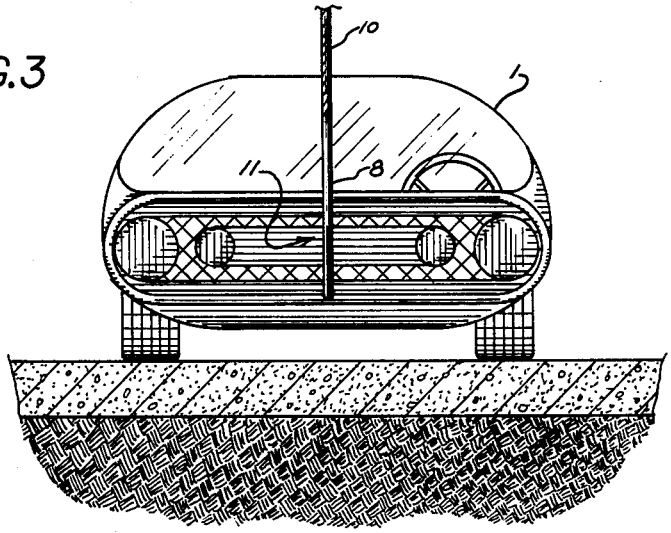
FIG. 3 is a sectional view of the parking space marker taken through line 3—3 of FIG. 1.

As can be seen by reference to FIGS. 1–3, the instant invention is directed to an elevated parking space marker structure designated generally as 3. The parking space marker 3 may be used with or without painted pavement line markers 2 to direct a vehicle 1 into the proper spatial relationships with other vehicles in a parking lot 15. The painted pavement line markers 2 as shown in FIG. 1 are depicted to represent "diagonal" parking but it should be apparent that the pavement markers 2 could be painted to represent "straight-in" parking.

The parking space marker 3 comprises a pair of upright rigid poles or stanchions 5 which are set into rigid support members 4 such as cast concrete etc. The poles may be cast into the support members or the support members may have a hollow recepticle into which the poles are inserted. Suspended between the stanchions or poles 5 is a horizontal support member 6 which is secured near the top of the poles 5 by suitable fastening means 7. The horizontal support member 6 may comprise a rigid pole, a taut wire or cable, a beam, etc. Vertically suspended from the horizontal support member 6 are a plurality of vertical parking space markers designated generally as 10. The vertical parking space markers 10 are positioned on the horizontal support member 6 to represent the accepted spatial relationships between cars in a parking lot.

As can be seen by reference to FIG. 1, the distance between the painted pavement lines 2 is represented by the distance designated as A, and the distance between the vertical parking space markers 10 is represented by the distance designated as A'. In the preferred embodiment, both of these distances A and A' are the same. It should also be noted that the vertical parking space markers bisect the distance A between the painted lines. The purpose for this spacing is to give the vehicle operator a visual point of reference in parking the car, so that the vertical parking space marker coincides with the middle of the front of the vehicle when parked.

The above example is a description of the preferred embodiment as depicted in FIG. 1. Obviously the vertical markers could be positioned directly over the painted pavement markers. The operator of the vehicle would then position the front of the car equidistant between the vertical markers. Signs (not shown) could be placed on the vertical supports 5 to indicate whether "diagonal" or "straight in" parking was required. In a "straight in" situation the vertical parking markers could also be positioned directly above the painted pavement markers or equidistant between them, with signs indicating whether to park between the vertical markers or head-on to an individual vertical marker.

Referring now more particularly to the construction of the vertical markers 10, it can be seen in FIG. 2 that the vertical markers 10 comprise a relatively flexible upper member 9 and a weighted relatively rigid lower member 8. The upper member is flexible to allow the lower member to swing easily away from an automobile which strikes it, due to careless operation of the vehicle in the parking manuever. The flexible upper member may be fabricated from chain, cord, cable, rope or any other suitable material. The lower member is relatively rigid to insure straightness, and also to present an impact surface, which will only require point contact to deflect it from the path of a vehicle which strikes it. The lower member is weighted to prevent the markers from swinging in the wind and also to maintain the vertical attitude of the markers. The lower members may be fabricated from resilienty covered wood, weighted plastic pipe, coated heavy cable etc. The lower member should be covered with a fluorescent, luminous or relective coating, to enhance the daytime visibility of the vertical markers, and also provide a surface which will be visible in headlight illumination during dawn, dusk and dark. The vertical markers 10 may be also provided with means (not shown) to discourage individuals from swinging on them or attempting to climb them.

As can be seen by reference to FIG. 3 the vertical marker 10 extends downwardly to a position whereby the first potential point of impact between the vertical marker 10 and the car 1 would be at the car bumper 11. The vertical marker 10 is designed so that it has no surfaces which could be caught on a car or truck, and also so that it will easily be deflected by a car which strikes it. An alternate embodiment (not shown) positions the end of the vertical marker 10 slightly above the standard roof height of an automobile, to minimize the occurrance of contact between the markers and a vehicle, and also to keep the marker above the reach of small children, while still, maintaining its effectiveness as a visual indicator.

Obviously many modifications and variations of the present invention are possible in light of the above teachings. It is therefore to be understood that, within the scope of the appended claims, the invention may be practiced otherwise than as specifically described.

What I claim is:

1. A parking space indicator and guide comprising:

at least two upright support members, a horizontal support to said upright support members, a plurality of means for providing parking space markers suspended from said horizontal support member, wherein;

said plurality of means for providing parking space markers are spaced one from the other a distance greater than the width of any car, and said distance coincides with standard width parking lane indicia.

2. A parking space indicator and guide as in claim 1; wherein, said plurality of means for providing parking space markers represent the normal spatial relationship of cars in parking lot.

3. A parking space indicator and guide as in claim 1; wherein, said parking space markers are swingingly supported on said horizontal support member.

4. A parking space indicator and guide as in claim 1; wherein, said means for providing parking space markers are vertically suspended from said horizontal support member to a point above the ground level which is below the level of a standard car bumper.

5. A parking space indicator and guide as in claim 1; wherein, said means for providing parking space markers are vertically suspended from said horizontal support member to a point above the ground level which is above the level of a standard car roof.

6. A parking space indicator and guide as in claim 1; wherein individual means for providing parking space markers designate individual parking spaces.

7. A parking space indicator and guide as in claim 1; wherein, pairs of said means for providing parking space markers designate individual parking spaces.

8. A parking space indicator and guide as in claim 1; wherein, said lower portion of said parking space marker is coated with a reflective material.

* * * * *